US007815283B2

(12) United States Patent
Slaats et al.

(10) Patent No.: US 7,815,283 B2
(45) Date of Patent: Oct. 19, 2010

(54) PRINTER WITH A MOVABLE CARRIAGE

(75) Inventors: Cornelis H. J. Slaats, Neer (NL); Barry B. Goeree, Drachten (NL); Henricus W. C. Douven, Nederweert Eind (NL); Jeroen A. A. Van Assen, Waalre (NL)

(73) Assignee: Oce-Technologies, B.V., Venlo (NL)

( * ) Notice: Subject to any disclaimer, the term of this patent is extended or adjusted under 35 U.S.C. 154(b) by 1007 days.

(21) Appl. No.: 11/600,204

(22) Filed: Nov. 16, 2006

(65) Prior Publication Data

US 2007/0115322 A1 May 24, 2007

(30) Foreign Application Priority Data

Nov. 18, 2005 (EP) ..... 05110956

(51) Int. Cl.
*B41J 23/00* (2006.01)
*B41J 25/308* (2006.01)

(52) U.S. Cl. ..... 347/37; 347/8

(58) Field of Classification Search ..... 347/8, 347/14, 37, 39; 358/296; 400/338.2, 320, 400/903; 101/352.01; 192/41 S; 474/8; 74/405

See application file for complete search history.

(56) References Cited

U.S. PATENT DOCUMENTS 3,482,511 A 12/1969 Tauchert et al.

FOREIGN PATENT DOCUMENTS

| | | |
|---|---|---|
| EP | 0623474 A2 | 4/1994 |
| EP | 0713781 A1 | 5/1996 |
| JP | 57-146676 A | 9/1982 |

*Primary Examiner*—Shih-Wen Hsieh
(74) *Attorney, Agent, or Firm*—Birch Stewart Kolasch & Birch, LLP

(57) ABSTRACT

A printer comprising a carriage, a guide rail and a print surface, the carriage being movable along the guide rail and carrying a printhead that faces the print surface and is movable in a direction normal to the plane of the print surface, wherein a stop or brake mechanism responsive to a movement of the printhead in said direction normal to the plane of the print surface is provided and adapted to stop the movement of the carriage.

8 Claims, 2 Drawing Sheets

PRINTER WITH A MOVABLE CARRIAGE

This application claims the priority benefit of European Patent Application No. 05110956.9 filed Nov. 18, 2005 which is hereby incorporated by reference.

BACKGROUND OF THE INVENTION

The present invention relates to a printer comprising a carriage, a guide rail and a print surface, the carriage being movable along the guide rail and carrying a printhead that faces the print surface and is movable in a direction normal to the plane of the print surface.

In a printer of this type, e.g., an ink jet printer, a sheet of paper or any other recording medium is advanced in a sub-scanning direction over the print surface. The printhead is arranged on the carriage in such a position that it faces the print surface, and a nozzle face of the printhead forms a narrow gap with the paper on the print surface. A drive mechanism causes the carriage to move back and forth in a main scanning direction along the guide rail, the position of the carriage in the main scanning direction being detected by means of a ruler or the like, and, on the basis of the detection result, the nozzles of the printhead are fired at appropriate timings, so that ink dots are printed in the intended positions on the paper. To this end, the position of the printhead on the carriage must be adjusted with high precision.

SUMMARY OF THE INVENTION

It is an object of the present invention to provide a printer in which the printhead is protected against damage or misadjustment that may result from a paper jam on the print surface.

In order to achieve this object, the printer according to the present invention comprises a stop mechanism responsive to the movement of the printhead in said direction normal to the plane of the print surface and adapted to stop the movement of the carriage.

When a paper jam occurs on the print surface, and the paper accumulates in the narrow gap between the print surface and the nozzle face of the printhead, which will impede or block the movement of the printhead in the main scanning direction, damage is likely to occur, if the drive mechanism continues to drive the carriage along the guide rail. However, the paper jam will also cause a slight upward movement of the printhead away from the print surface, typically 1-3 millimeters, and, according to the present invention, this movement will trigger the stop mechanism, so that damage is avoided by forcibly bringing the carriage to a stop. This can be at any position along the guide rail.

In a preferred embodiment, the printhead is rigidly mounted to the carriage, and the upward movement of the printhead relative to the print surface is made possible by a tilting movement of the carriage, including the printhead, about a fulcrum on the guide rail. Then, the stop mechanism will also have the effect to protect the carriage against running out of the guidance.

The guide rail and the carriage may be designed so as to provide an end stop which limits the tilting movement of the carriage and hence the lift movement of the printhead to a relatively small amount.

In one embodiment, the co-operating end stops on the guide rail and on the carriage are configured as brake surfaces that will be brought into engagement with one another when the paper jam causes the lift movement of the printhead. Thus, the stop mechanism is embodied as a brake mechanism, and the force that is created by the paper and tends to lift the printhead away from the print surface is directly used as a brake actuating force for the brake mechanism.

In another embodiment, one of the end stops, preferably the one on the carriage, is configured as a switch or contact sensor which issues an electronic signal to stop the drive mechanism as soon as the printhead has been lifted to such an extent that the sensor or switch is actuated.

In other embodiments, the printhead may be mounted to be movable relative to the carriage in a direction normal to the plane of the print surface, and the brake and the sensor or switch, respectively, may be actuated by the relative movement between the printhead and the carriage.

BRIEF DESCRIPTION OF THE DRAWINGS

Preferred embodiments of the invention will now be described in conjunction with the drawings wherein.

DETAILED DESCRIPTION OF THE INVENTION

Figure 1:
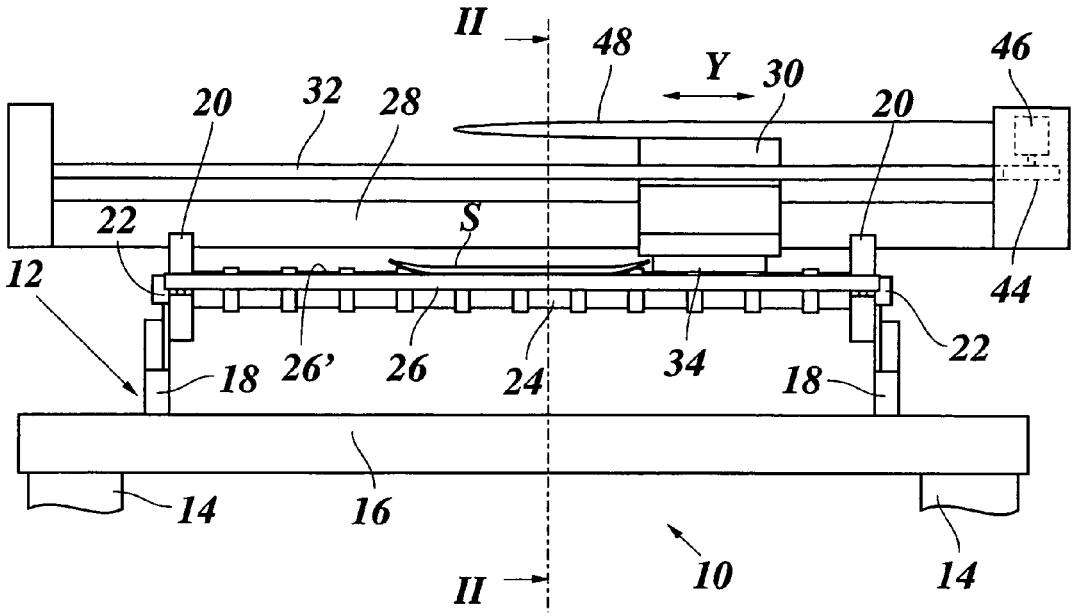
FIG. 1 is a front view of a printer according to the invention.

The printer shown in FIG. 1 comprises a frame 10 having a lower support structure 12 formed by two uprights 14, two cross-bars 16, and two mounting plates 18 rising up from the cross-bars 16. A plate-like function block 20 is attached to each of the mounting plates 18 and extends in parallel therewith. Two bearings 22 rotatably support a feed roller 24 between the two mounting plates 18.

A sheet support plate 26 is horizontally supported on the two function blocks 20 and forms a print surface 26' which serves to support a sheet S of a recording medium which is advanced in an X-direction (normal to the plane of the drawing in FIG. 1) by means of the feed roller 24. A drive mechanism for the feed roller 24 has not been shown here for simplicity.

A guide rail 28 rests on the top ends of the function blocks 20 and extends in parallel with the axial direction Y of the feed roller 24. A carriage 30 is guided on the guide rail 28 and is driven to move back and forth along the guide rail by means a drive mechanism formed by a belt 32, for example. The carriage 30 has a portion extending over the sheet support plate 26, and a printhead 34 is mounted on the bottom side of this carriage portion so as to face the sheet S that is advanced over the print surface 26'. The printhead 34 may be, for example, a hot melt ink jet printhead.

A detection and control system, which may have a conventional design and has not been shown here, detects the Y-position of the carriage 30 and determines the timings at which the print units or nozzles of the printhead 34 are energized while the carriage moves across the recording medium.

Figure 2:
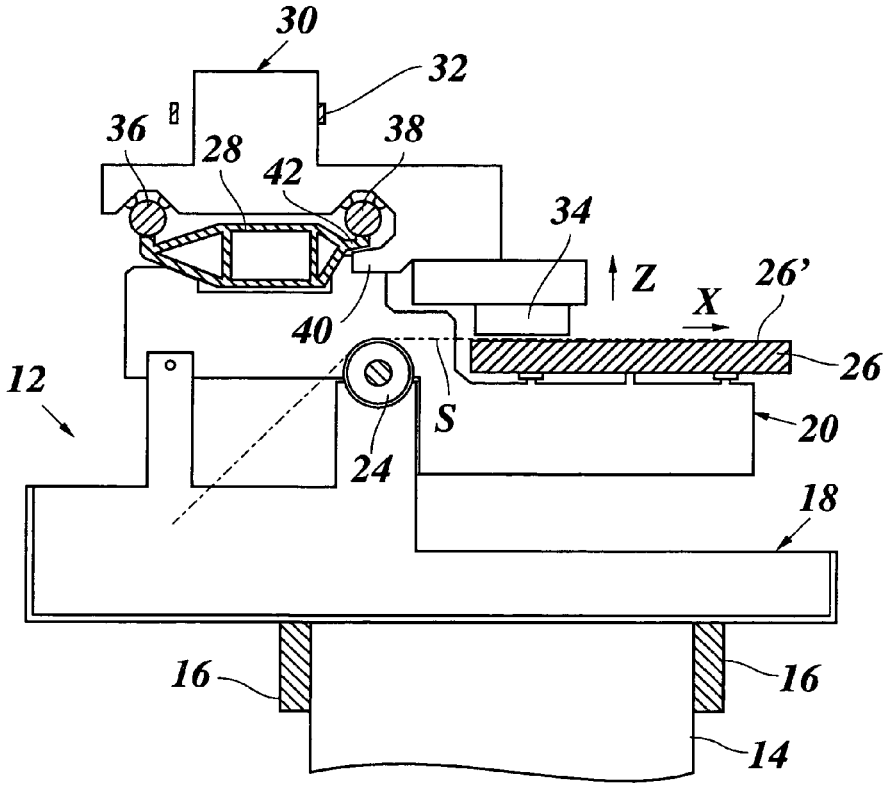
FIG. 2 is a cross-section along the line II-II in FIG. 1.

As is shown in FIG. 2, the guide rail 28 is formed by a profile member which supports two cylindrical rods 36, 38 on which the carriage 30 is supported and guided with roller bearings. The guide rail 28 rests on V-shaped top surfaces of the function blocks 20 and is thereby accurately positioned in the X-direction, i.e., the direction, in which the recording medium advances, and in the vertical Z-direction normal to the print surface 26'.

When the printhead 34 is subject to an upwardly directed force, it may be lifted away from the print surface 26' in the direction Z, because the carriage 30, to which the printhead is rigidly connected, is capable of tilting about the cylindrical rod 36. This tilting movement, however, is limited by an end stop 40 that projects from the carriage 30 and forms a little clearance with the bottom side of a flange 42 of the guide rail 28.

As is shown in FIG. 1, the belt 32 is trained around a pulley 44 that is driven by a motor 46. When the printer is operating, the motor 46 is speed-controlled, so that the carriage 30 is moved along the guide rail 28 with uniform velocity. Print signals are transmitted to nozzle actuators of the printhead 34 through a flexible cable 48.

The feed roller 24 and the sheet support plate 26 are capable of handling sheets S or webs of paper of varying width, corresponding to sheet sizes from A4-A0, for example. In FIG. 1, a sheet S of relatively small size is advanced over the print surface 26', and, as has been shown exaggeratedly in the drawing, the edges of the sheet S are curled upwardly, so that they will be hit by the printhead 34 when the carriage 30 moves along the guide rail. In the case of such an event, the sheet S will crumple in the gap between the nozzle face of the printhead and the print surface, so that a severe paper jam may occur, which involves the risk that the printhead 34 or parts of the mounting structure thereof are damaged or distorted. This risk is not eliminated by the fact that the printhead 34 is capable of being lifted away from the print surface 26' within certain limits, as has been described above, because, as long as the carriage 30 moves on, the paper will tend to accumulate further in the gap between the print surface and the printhead.

Figure 3:
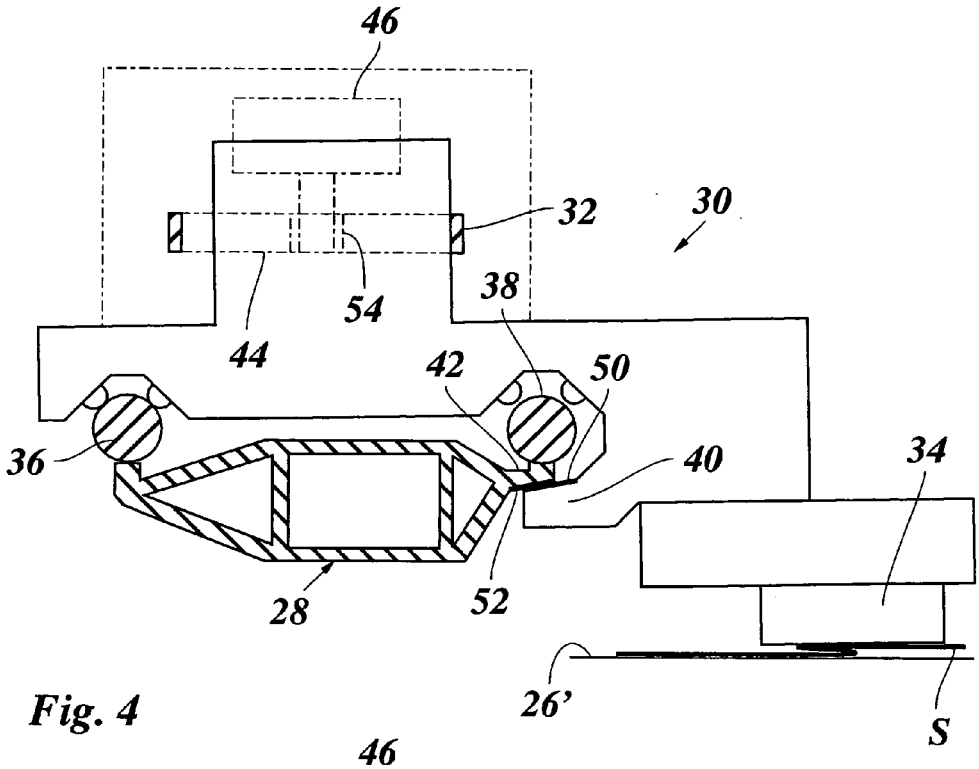
FIGS. 3 and 4 are enlarged views of a carriage and a guide rail of the printer and show different embodiments of a stop mechanism.

In order to avoid this risk, the end stop 40 and the flange 42 are configured to provide a stop mechanism for the carriage 30, as has been shown in FIG. 3. This figure illustrates a situation where the sheet S has jammed between the print surface 26' and the nozzle face on the bottom side of the printhead 34, so that the carriage 30 has been tilted about the central axis of the cylindrical rod 36. The end stop 40 on the carriage 30 and the flange 42 of the guide rail 28 are formed with brake surfaces 50 and 52, respectively, which provide a relatively high friction coefficient and are so inclined that they are brought into mating engagement with one another by the tilting movement of the carriage 30. Thus, as soon as the paper jam causes the brake surfaces 50 and 52 to be pressed against one another, the movement of the carriage 30 along the guide rail 28 will be braked. The motor 46 may continue to rotate, but a slip coupling 54 between the output shaft of the motor and the pulley 44 prevents the belt 32 from being moved further and from overcoming the braking force of the brake surfaces 50, 52. Thus, the brake surfaces 50, 52 form a simple and yet efficient and sensitive stop mechanism which will bring the carriage 30 to a stop before the paper jam becomes worse and causes damage to the printhead 34. As an alternative for the slip-type coupling, the motor 26 can be provided with an overload switch that stops the motor when the resistance caused by the brake surfaces becomes larger.

When the paper jam has been removed, the carriage 30 will tilt back into its original position in which it is supported on the rod 38, and the print process may be resumed.

Figure 4:
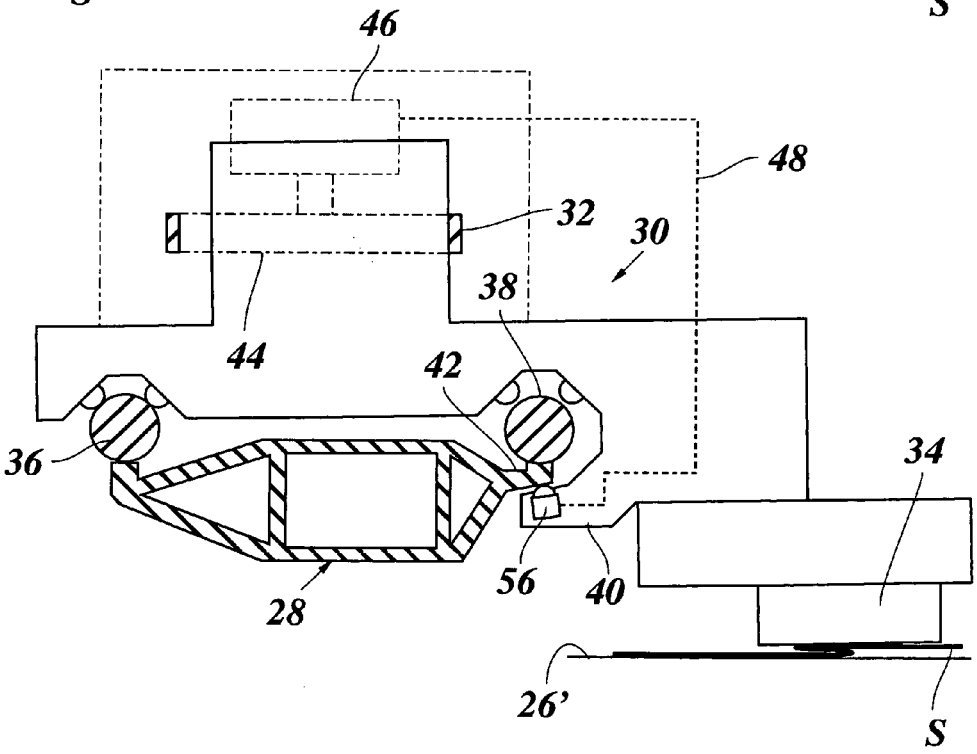

FIG. 4 illustrates a modified embodiment, wherein the brake mechanism is formed by a sensor 56 or a switch that is mounted on the end stop 40 in such a position that is faces the bottom side of the flange 42 and delivers an electronic signal as soon as the sensor 56 contacts the flange 42. This signal is transmitted to the drive circuit for the motor 46 via the cable 48 and causes the motor 46 to stop. The motor 46 may be a step-motor or, more generally, a motor that is capable of creating a high braking force, so that the carriage 30 will be stopped instantaneously as soon as a paper jam occurs.

It will be understood that the two types of stop mechanism described above may also be combined with one another.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A printer comprising a carriage, a guide rail, a drive train for driving the carriage in a direction (Y) parallel to the guide rail, and a print surface, the carriage being movable along the guide rail and carrying a printhead that faces the print surface and is movable in a direction (Z) normal to the plane of the print surface, wherein, a stop mechanism responsive to a movement of the printhead in said direction (Z) normal to the plane of the print surface is provided and adapted to stop the movement of the carriage in the direction (Y) parallel to the guide rail.

2. The printer according to claim 1, wherein the printhead is rigidly mounted to the carriage, and the carriage is capable of tilting about a fulcrum formed by the guide rail.

3. The printer according to claim 2, wherein the brake surfaces are formed on the carriage and the guide rail, respectively.

4. The printer according to claim 3, wherein the guide rail comprises two parallel cylindrical rods supporting the carriage, the brake surface of the guide rail is formed on a flange that extends below one of said rods, on the side facing away from this rod, and the brake surface of the carriage is formed on an end stop projecting from the body of the carriage.

5. The printer according to claim 1, wherein the stop mechanism comprises two brake surfaces that are brought into engagement with one another by the movement of the printhead in said direction (Z) normal to the plane of the print surface and which create a braking force that overcomes the driving force of the drive train.

6. The printer according to claim 1, wherein a drive train for the carriage comprises a slip-type coupling.

7. The printer according to claim 1, wherein the stop mechanism comprises a sensor for detecting the movement of the printhead in said direction (Z) normal to the plane of the print surface and for generating a signal to stop a motor that drives the carriage.

8. The printer according to claim 7, wherein the sensor is mounted on the carriage in a position facing a flange of the guide rail.

* * * * *